US008672748B2

(12) United States Patent
Arnone et al.

(10) Patent No.: US 8,672,748 B2
(45) Date of Patent: Mar. 18, 2014

(54) PERSONALIZABLE HYBRID GAMES

(71) Applicant: Gamblit Gaming, LLC, Glendale, CA (US)

(72) Inventors: Miles Arnone, Sherborn, MA (US); Frank Cire, Pasadena, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 13/888,326

(22) Filed: May 6, 2013

(65) Prior Publication Data

US 2013/0244765 A1 Sep. 19, 2013

Related U.S. Application Data

(63) Continuation of application No. PCT/US2012/046441, filed on Jul. 12, 2012.

(60) Provisional application No. 61/572,135, filed on Jul. 12, 2011, provisional application No. 61/629,018, filed on Nov. 10, 2011.

(51) Int. Cl.
*A63F 9/24* (2006.01)
*G07F 17/00* (2006.01)

(52) U.S. Cl.
USPC ..... 463/25

(58) Field of Classification Search
USPC ..... 463/1, 16, 20, 25, 42
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 A 10/2001
JP 2003111980 A 4/2003

(Continued)

OTHER PUBLICATIONS

Itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

(Continued)

*Primary Examiner* — William Brewster
*Assistant Examiner* — Jason Skaarup
(74) *Attorney, Agent, or Firm* — Frank Cire

(57) ABSTRACT

Methods and systems for personalizable hybrid games including a gambling game and an entertainment game are provided. A hybrid game includes a real world engine configured to provide a randomly generated payout for a gambling game and a game world engine configured to manage an entertainment software engine to provide outcomes based upon a player's skillful execution of an entertainment game. Parameter data indicative of player performance when playing the entertainment game at a first difficulty setting is collected and a difficulty setting is selected for the entertainment game based upon the collected parameter data. An amount of real world credit to be wagered in the gambling game may be determined based on the selected difficulty setting for the entertainment game, where real world credit is credit used in the gambling game.

14 Claims, 8 Drawing Sheets

500

(56) References Cited

U.S. PATENT DOCUMENTS 5,785,592 A 7/1998 Jacobsen
6,050,895 A 4/2000 Luciano
6,227,974 B1 5/2001 Eilat
6,267,669 B1 7/2001 Luciano
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0139214 A1 7/2003 Wolf et al.
2003/0171149 A1 9/2003 Rothschild
2003/0204565 A1 10/2003 Guo et al.
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0234791 A1 10/2006 Nguyen et al.
2006/0258433 A1 11/2006 Finocchio et al.
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0117641 A1 5/2007 Walker et al.
2007/0129149 A1 6/2007 Walker
2007/0156509 A1 7/2007 Jung et al.
2007/0167212 A1 7/2007 Nguyen
2007/0167239 A1 7/2007 O'Rourke
2007/0191104 A1 8/2007 Van Luchene
2007/0203828 A1 8/2007 Jung et al.
2007/0293306 A1 12/2007 Nee et al.
2008/0004107 A1 1/2008 Nguyen et al.
2008/0015004 A1 1/2008 Gatto et al.
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1* 5/2008 Oberberger ..... 463/16
2008/0108425 A1* 5/2008 Oberberger ..... 463/25
2008/0119283 A1* 5/2008 Baerlocher ..... 463/42
2008/0146308 A1 6/2008 Okada
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0061974 A1 3/2009 Lutnick et al.
2009/0061991 A1* 3/2009 Popovich et al. ..... 463/25
2009/0061997 A1* 3/2009 Popovich et al. ..... 463/26
2009/0061998 A1* 3/2009 Popovich et al. ..... 463/26
2009/0061999 A1* 3/2009 Popovich et al. ..... 463/26
2009/0082093 A1 3/2009 Okada
2009/0098934 A1 4/2009 Amour
2009/0118006 A1 5/2009 Kelly et al.
2009/0124344 A1 5/2009 Mitchell et al.
2009/0131158 A1* 5/2009 Brunet De Courssou et al. ..... 463/26
2009/0131175 A1 5/2009 Kelly et al.
2009/0143141 A1 6/2009 Wells
2009/0149233 A1 6/2009 Strause et al.
2009/0176560 A1 7/2009 Herrmann et al.
2009/0176566 A1 7/2009 Kelly
2009/0221355 A1 9/2009 Dunaevsky et al.
2009/0247272 A1 10/2009 Abe
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0035674 A1 2/2010 Slomiany
2010/0056247 A1 3/2010 Nicely
2010/0062836 A1 3/2010 Young
2010/0093420 A1 4/2010 Wright
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304839 A1 12/2010 Johnson
2010/0304842 A1 12/2010 Friedman et al.
2011/0009177 A1 1/2011 Katz
2011/0009178 A1 1/2011 Gergon
2011/0045896 A1 2/2011 Sak et al.
2011/0077087 A1 3/2011 Walker et al.
2011/0082571 A1 4/2011 Murdock et al.
2011/0109454 A1 5/2011 McSheffrey

(56) References Cited

U.S. PATENT DOCUMENTS

| | | | | |
|---|---|---|---|---|
| 2011/0111820 | A1* | 5/2011 | Filipour et al. | 463/16 |
| 2011/0111837 | A1 | 5/2011 | Gagner | |
| 2011/0118011 | A1 | 5/2011 | Filipour et al. | |
| 2011/0207523 | A1 | 8/2011 | Filipour et al. | |
| 2011/0212766 | A1 | 9/2011 | Bowers | |
| 2011/0212767 | A1 | 9/2011 | Barclay | |
| 2011/0218028 | A1 | 9/2011 | Acres | |
| 2011/0218035 | A1 | 9/2011 | Thomas | |
| 2011/0230258 | A1 | 9/2011 | Van Luchene | |
| 2011/0230260 | A1 | 9/2011 | Morrow et al. | |
| 2011/0244944 | A1 | 10/2011 | Baerlocher | |
| 2011/0263312 | A1 | 10/2011 | De Waal | |
| 2011/0269522 | A1 | 11/2011 | Nicely et al. | |
| 2011/0275440 | A1 | 11/2011 | Faktor | |
| 2011/0287828 | A1 | 11/2011 | Anderson et al. | |
| 2011/0287841 | A1 | 11/2011 | Watanabe | |
| 2011/0312408 | A1 | 12/2011 | Okuaki | |
| 2012/0058814 | A1 | 3/2012 | Lutnick | |
| 2012/0077569 | A1 | 3/2012 | Watkins | |
| 2012/0108323 | A1 | 5/2012 | Kelly | |
| 2012/0202587 | A1 | 8/2012 | Allen | |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2011109454 | A1 | 9/2011 |
| WO | 2012078668 | A1 | 6/2012 |
| WO | 2012139083 | A1 | 10/2012 |
| WO | 2012167146 | A1 | 12/2012 |
| WO | 2012167275 | A2 | 12/2012 |
| WO | 2013010036 | A1 | 1/2013 |

OTHER PUBLICATIONS

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

International Search Report and Written Opinion, PCT/US2012/046441, Nov. 16, 2012.

* cited by examiner 702 704 706

| Difficulty | GWC accumulation /unit time | Element consumption/ unit time | ... |
|---|---|---|---|
| 1 | 100 | 100 | ... |
| 2 | 180 | 200 | ... |
| 3 | 200 | 300 | ... |
| 4 | 180 | 400 | ... |
| 5 | 100 | 500 | ... |
| ... | ... | ... | ... |

700

FIG. 7

PERSONALIZABLE HYBRID GAMES

CROSS REFERENCE TO RELATED APPLICATIONS

This application is a continuation of Patent Cooperation Treaty Application No. PCT/US12/46441, filed on Jul. 12, 2012, which claims the benefit of U.S. Provisional Patent Application No. 61/572,135, filed Jul. 12, 2011, and U.S. Provisional Patent Application No. 61/629,018, filed Nov. 10, 2011, the contents of each of which are hereby incorporated by reference as if stated in full herein.

FIELD OF THE INVENTION

The present invention is generally related to gaming and more specifically to personalization of a hybrid game that includes both a gambling game and an entertainment game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Methods and systems for operating a hybrid game that includes a real world engine configured to provide a randomly generated payout for a gambling game and a game world engine configured to manage an entertainment software engine to provide outcomes based upon a player's skillful execution of an entertainment game are provided.

In exemplary embodiments, parameter data indicative of player performance when playing the entertainment game at a first difficulty setting is collected, a difficulty setting for the entertainment game is selected based upon the collected parameter data is, and an amount of real world credit to be wagered in the gambling game based on the selected difficulty setting for the entertainment game is determined, where real world credit is credit used in the gambling game.

In numerous exemplary embodiments, a rate of consumption of an element of the entertainment game based on the selected difficulty setting for the entertainment game is determined, where an element is a limited resource utilized within the entertainment game to advance gameplay, and an amount of real world credit to be wagered based on the determined rate of consumption of the element is determined.

In many exemplary embodiments, a modification of a parameter indicative of player performance at the entertainment game is received, and an amount of real world credit to be wagered based on the modification of the parameter is determined.

In various exemplary embodiments, the modification of the parameter is a modification of the length of time that a player is playing the hybrid game.

In several exemplary embodiments, the modification of the parameter is a modification of a maximum amount of real world credit that can be wagered.

In numerous exemplary embodiments, the modification of the parameter is a modification of a minimum amount of real world credit that can be wagered.

In many exemplary embodiments, the collected parameter data is game world credit accumulation data, where game world credits are credits accumulated in the entertainment game, and a difficulty setting is selected based upon maximized game world credit accumulation.

In various exemplary embodiments, the parameter data indicative of player performance is collected when playing the entertainment game at a second difficulty setting.

BRIEF DESCRIPTION OF THE DRAWINGS

FIG. 7 illustrates a table of parameter data collected while evaluating a player's performance at various entertainment game difficulty settings.

DETAILED DESCRIPTION

Figure 1:
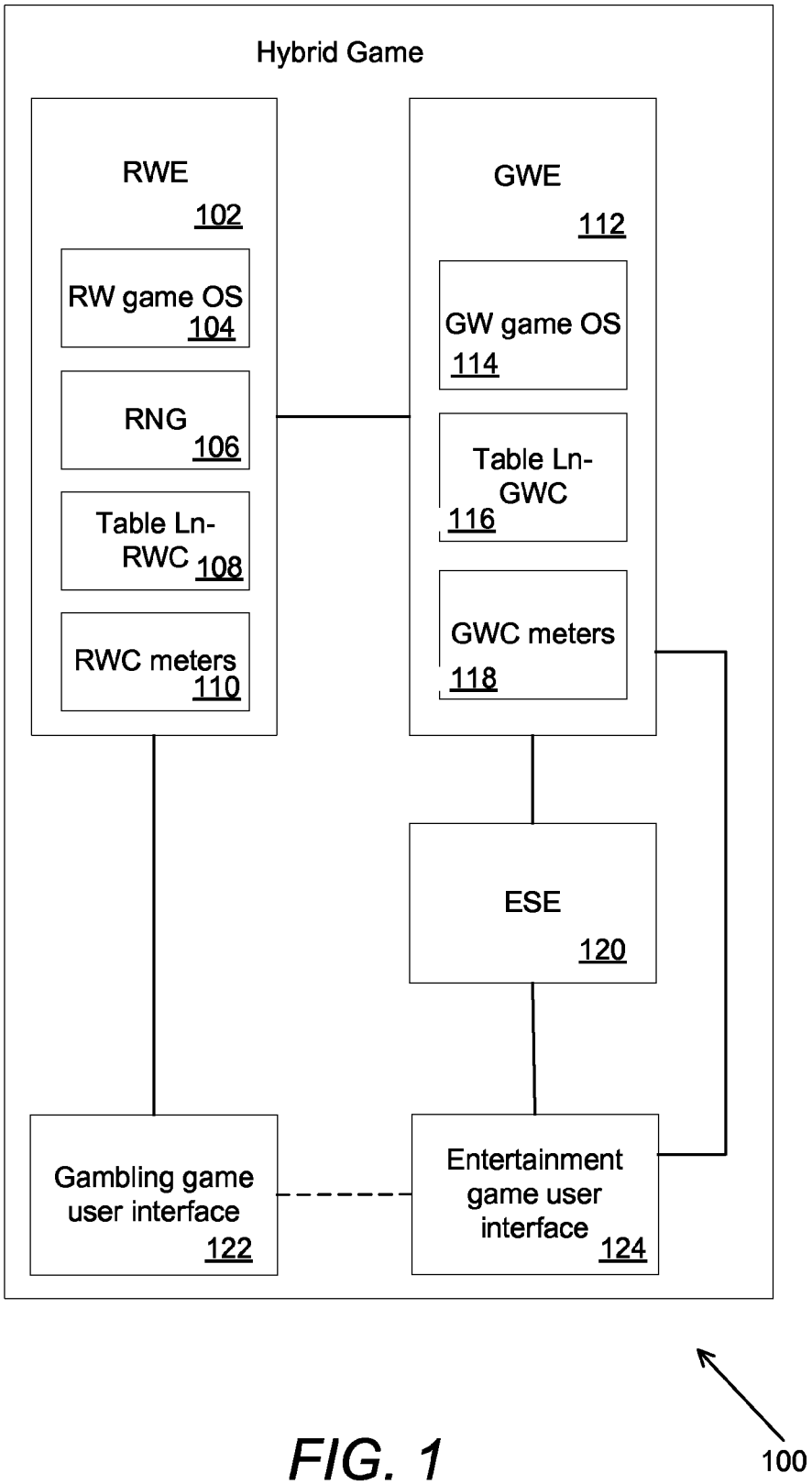
FIG. 1 illustrates a personalizable hybrid game in accordance with an embodiment of the invention.

Turning now to the drawings, systems and methods for a hybrid game capable of being personalized to a player of the hybrid game are described. In many embodiments, a player of a hybrid game may manually select from a number of options to personalize a hybrid game according to player preferences. A player can be any entity, individual or corporation, capable of personalizing a hybrid game. In several embodiments, the personalization is performed automatically without player input, including (but not limited to) determining a player skill level and configuring the hybrid game according to an appropriate entertainment game difficulty setting.

In several embodiments, a hybrid game is a game that integrates both a gambling game that includes a real world engine (RWE) which manages the gambling game, as well as an entertainment game that includes a game world engine (GWE) which manages the entertainment portion of a game, and an entertainment software engine (ESE) which executes the game for player entertainment. In certain embodiments, the hybrid game also includes a user interface associated with either or both the gambling game and the entertainment game. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety. The RWE, GWE and ESE are also discussed further below.

In numerous embodiments, a personalizable hybrid game can allow a player to access information useful to the player in personalizing the hybrid game, such as to display a demonstration on game use and possible outcomes from different modifications of hybrid game parameters (such as but not limited to RWC available to the gambling game, game play time and entertainment game difficulty setting) that a player can make to personalize the hybrid game. Also, a player may manually personalize a game, such as by (but not limited to) setting the difficulty setting at which the hybrid game is performing, determining the conversions between elements, real world credits (RWC) and game world credits (GWC), setting game play time or goals to be reached during gameplay, setting up a player account or settings for interactions with a virtual community.

In a number of embodiments, a personalizable hybrid game can automatically configure the entertainment game to operate at an appropriate difficulty setting to match a player's skill level. In certain embodiments, a process for configuring an entertainment game to operate at an appropriate difficulty setting includes collecting parameter data indicative of player performance at an entertainment game, evaluating the player performance across different difficulty settings of the entertainment game, determining an appropriate difficulty setting and configuring the entertainment game according to the appropriate difficulty setting. In various embodiments, a determination of an appropriate difficulty setting for a player's skill level is an iterative process where the entertainment game is set at a difficulty setting, data is collected based upon a player's entertainment game performance at the difficulty setting, and the process is repeated for additional difficulty settings of interest. In numerous embodiments, a determination of an appropriate difficulty setting is performed by finding the difficulty setting with the maximum GWC accumulation rate.

Although specific embodiments of personalizable hybrid game are discussed above, hybrid games can be personalized using a variety of processes as appropriate to the requirements of a specific application in accordance with embodiments of the invention. Personalizable hybrid games in accordance with embodiments of the invention are discussed further below.

Hybrid Games

In many embodiments, a hybrid game provides players with high levels of entertainment content with a game of skill in the gambling experience. These hybrid games provide for a random outcome independent of player skill while ensuring that the player's gaming experience (as measured by obstacles/challenges encountered, time of play and other factors) is shaped by the player's skill. A personalizable hybrid game in accordance with an embodiment of the invention is illustrated in FIG. 1. The hybrid game includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, The RWE 102 is the fundamental operating system for the gambling game of the hybrid game and controls and operates the gambling game. The operation of a gambling game is enabled by money, such as real funds, accretes and declinates real gambling credits based on random gambling outcome, and whose gambling proposition is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithm and/or process which are used to generate random outcomes. A level n real-world credit pay table (Table Ln-RWC) 108 is a table that can be used in conjunction with a random number generator (RNG) 106 to dictate the real world credits (RWC) earned as a function of game play and is analogous to the pay tables used in a conventional slot machine. Table Ln-RWC payouts are independent of player skill. There may be one or a plurality of Table Ln-RWC pay tables 108 contained in a gambling game, the selection of which may be determined by game factors including (but not limited to) progress a player has earned, and/or bonus rounds which a player may be eligible for. Real world credits (RWC) are credits analogous to slot machine game credits which are entered into a gambling game by the player, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a game cash out is opted for by a player. The amount of RWC required to enter a specific level of the game "level n" need not be the same for each level. In many embodiments, the GWE 112 manages the overall hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and activities related to the game. The GWE 112 furthermore couples to the ESE 120.

In many embodiments, a level "n" game world credit pay table (Table Ln-GWC) 116 dictates the GWC earned as a function of player skill in the nth level of the game. The payouts governed by this table are dependent upon player skill and game play at large and may or may not be coupled to a random number generator. In several embodiments, game world credits (GWC) are player points earned or depleted as a function of player skill (i.e. as a function of player performance in the context of the game). GWC is analogous to the "score" in a typical video game. Each game has one or more scoring criterion, embedded within the Table Ln-GWC 116 that reflects player performance against the goal(s) of the game. GWC can be carried forward from one level of game play to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including (but not limited to) as the wager amount, how fast the player wants to play (by pressing a button or pulling the slot's handle), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey the status of the RWE (such as on-line or tilt). The communication link can further communicate various gambling control factors which the RWE 102 uses as input, including but not limited to the number of RWC consumed per game or the player's election to enter a jackpot round. In FIG. 1, the GWE 112 is also shown as connecting to the player's user interface directly, as this may be utilized to communicate certain entertainment game aspects, such as (but not limited to) club points, player status, control the selection of choices and messages which a player may find useful in order to adjust the entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWC 112. In certain embodiments, control information to the ESE 120 from the GWE 112 includes control information used to personalize a hybrid game. In several embodiments an ESE 120 can be implement using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific game program.

The ESE 120 operates mostly independently from the GWE 112, except that via the interface, the GWE 112 may send certain GW game control parameters to the ESE 120 to affect its play, such as (but not limited to) what level of character to be using, changing the difficulty setting of the game, changing the type of gun or car in use, requesting potions to become available or to be found by the character, etc. The ESE 120 can accept this input from the GWE 112, make adjustments, and continue the play action all the while running seamlessly from the player's perspective. The ESE's operation is mostly skill based, except for where the ESE's algorithm may inject complexities into the game by chance in its normal operation to create unpredictability in the entertainment game. Utilizing this interface, the ESE 120 may also communicate player choices made in the game to the GWE 112, such as (but not limited to) selection of a different gun and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including (but not limited to) popular titles from arcade and home video games, such as (but not limited to) Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors to the GWE 112 that result in increases/decreases in wagers as a function of the player's decision making as to the player's operational profile in the entertainment game (i.e. power of the character, gun selection, car choice, etc.). In this manner, the player is always in control of the per game wager amount, with the choice mapping to one or more parameter or component which is applicable to the entertainment game experience of the hybrid game. In several embodiments, the RWE 102 operation can be a game of chance running every 10 seconds where the amount wagered is communicated from the GWE 112 as a function of choices the player makes in the operation profile in the entertainment game such as those cited above.

In numerous embodiments, actions taken by the player in the entertainment game trigger a gambling game through an enabling element of the entertainment game. Enabling elements are consumable and replenishable elements in an entertainment game that enable a player to play the entertainment game while consuming the element. There may be one or more enabling element types in use in the entertainment game, either simultaneously or serially. Enabling element types include, but are not limited to, game objects used by the player while playing the entertainment game such as bullets, fuel, health points, potions, etc.

In many embodiments, an enabling element may be incremented or decremented in the entertainment game based on the outcome of the gambling game. For example, a winning outcome in the gambling game may result in an increment of some, all or an excess of an amount of an enabling element that was consumed by the player in triggering the gambling game.

In various embodiments, actions taken by the player in the entertainment game trigger a gambling game through an action element of the entertainment game. Action elements are entertainment game elements or objects that are acted upon by a player while playing in an entertainment game. There may be one or more action element types available for use in the entertainment game, either simultaneously or serially. Exemplary action actions include (but are not limited to) doors that a player can chose to open, chests that a player can choose to open, non-player characters that the player can interact with, waypoints or checkpoints in the entertainment game, objectives to be achieved, etc.

In several embodiments, an enabling element may be reset, replaced, added or removed in the entertainment game based on the outcome of the gambling game. For example, a winning outcome in the gambling game may result in a reset of the action element such that the player can again interact with the action element while a losing outcome from the gambling game may result in the action element being deactivated or removed entirely from the entertainment game.

In many embodiments, a hybrid game integrates a video game style gambling machine, where the gambling game (i.e. RWE 102 and RWC) is not player skill based, while at the same time allows players to use their skills to earn club points that a casino operator can translate to rewards, tournaments opportunities and prizes for the players. The actual exchange of monetary funds earned or lost directly from gambling against a game of chance, such as a slot machine, is preserved. At the same time a rich environment of rewards to stimulate "garners" can be established with the entertainment game. In several embodiments, the hybrid game can leverage very popular titles with "garners" and provides a sea change environment for casinos to attract players with games that are more akin to the type of entertainment which a younger generation desires. In various embodiments, players can use their skill towards building and banking GWC which in turn can be used to win tournaments and various prizes as a function of their "gamer" prowess. Numerous embodiments minimize the underlying changes needed to the aforementioned entertainment software (Gears of War, etc.), for the hybrid game to operate within an entertainment game construct, thus making a plethora of complex game titles and environments, rapid and inexpensive to deploy in a gambling environment.

In certain embodiments, hybrid games also allow players to gain entry into subsequent competitions through the accumulation of game world credits (GWC) that accrue as a function of the player's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

Although specific personalizable hybrid games are discussed above, hybrid games can be personalized using a variety of processes as appropriate to the requirements of a specific application in accordance with embodiments of the invention. Processes for providing information concerning hybrid games and for personalizing hybrid games in accordance with embodiments of the invention are discussed further below.

Personalization of Hybrid Games

A player may wish to personalize aspects of a hybrid game including (but not limited to) the difficulty of the entertainment game and the relationships between the entertainment game and the RWCs wagered in a gambling game. In several embodiments, a player may manually select an option for the hybrid game to automatically configure itself, such as where a hybrid game may automatically configure an entertainment game to an appropriate difficulty setting based upon a player's skill level.

In a variety of embodiments, players can have the hybrid game perform a skill level assessment of the player in order to set the entertainment game of the hybrid game to an appropriate difficulty level. In certain embodiments, a hybrid game can assess the skill level of a player by providing a player interactive dry run at the entertainment game for one or more sample scenarios. In particular embodiments, a player is informed that a skill level assessment will be performed to rank performance against different difficulty settings of the game. As players play the supplied scenario(s), the hybrid game can run an algorithm and monitor the parameters associated with performance, such as (but not limited to) a player's GWC, element consumption, and RWC score. The parameters can be monitored against a set of benchmarks to determine skill level. Thereby, players can also be given an opportunity to experience the game and gain familiarity with the hybrid game, either free of charge, or without having to commit a significant amount of funds to do so. In particular embodiments, performance information is supplied to the player, such as (but not limited) to a recommended difficulty setting for the entertainment game. A follow on function of these assessment round(s) can be to define for players the range of outcomes they might expect in both the gambling and entertainment games of the hybrid game. In certain embodiments, upon successful completion of the player assessment option, the player can be guided to further personalize the hybrid game, so that information about the player gleaned from the assessment round(s) can be utilized to tailor the hybrid game in a manner which is enticing to the player.

In several embodiments, a hybrid game contains the necessary formulae, tables and algorithms to evaluate a player's performance during the assessment round(s) in order to develop a handicap for the player. Such handicaps could be used as defaults for hybrid settings, used as suggestions for configuring a hybrid game, or used to class players with other players of roughly the same skill level. This implies that the hybrid game can incorporate a learning function in its algorithms, such that over a period of time, an accurate handicapping of a player is formed and used by the game and the system for supporting tournaments, and enhancing the player community. In certain embodiments, the skill assessment is skipped or disabled with respect to a player who has logged in with an account for which there is recent activity and for which exists a proven skill assessment level.

In many embodiments, a player has an option to modify game parameters. A hybrid game allows a game manufacturer, a regulator or a casino operator to control ranges of game parameters selectable by the player, such as the range of complexity, root denomination of the game (as it would relate to amount of RWC used for entertainment game actions taken by the player such as pulling the trigger on a gun or casting a spell), the minimum and maximum amount of time scaling (which is the range of time for which the player could expect to play the game given the player's skill and a specified amount of RWC to be committed to the game), and other parameters which the player can control.

In certain embodiments, a player may select a difficulty setting for the entertainment game, such as beginner, amateur, experienced, hardened veteran and expert. In particular embodiments, player that plays at a more advanced difficulty setting (such as "expert) would be in a position to garner more GWC per unit of time played than a player that plays at a less advanced difficulty setting (such as "beginner"), at the expense of making survival in the game much more difficult.

In a number of embodiments, the difficulty setting of the entertainment game can be set automatically for a player (such as from a process of evaluating the game play performance of a player and configuring the game according to the game play performance).

In various embodiments, a player can choose to determine denomination scaling, or the selection of the quantity of RWCs that are placed into gambling game play as per consumption or use of each unit of an element that is consumed. Elements are entertainment game gameplay limited resources that are utilized during the performance of the entertainment game in order to advance gameplay. In many embodiments, elements include but are not limited to ammunition, such as bullets, used in a shooting entertainment game involving shooting a gun, money in a real estate entertainment game involving the purchase of properties or soldiers in a war entertainment game involving commanding a number of soldiers in battles. In certain embodiments, denomination scaling would allow the amount of actual RWC used per bullet (an element) to be scaled between ⅕ RWC up to 3 RWC when the default RWC used for firing a bullet (an element) costs 1 credit. Denomination scaling allows skilled players who want a challenging environment, but who have limited financial means, to enjoy a satisfying and relatively lengthy play session. In many embodiments, as a function of fairness, a formula would exist linking the denomination scaling in some manner to the complexity setting of the game. In certain embodiments, the rate of possible GWC accumulation can be impacted as the denomination was scaled up or down.

In numerous embodiments, a player may select a time scaling option which allows a player to set the complexity, and RWC use rate as a function of a range of the amount of time that the player would want to play, considering factors such the amount of funds available and the skill level of the player. Although the actual time of use could not always predictably be highly accurate, based on statistics of play and the game, a projection of a range of anticipated play time, ignoring extraordinary jackpots, can be predictable for the hybrid game.

In many embodiments, a player may select an option for tournament scaling which allows a player to configure the complexity and RWC use in a manner which, if possible, gives the player a chance of qualifying for an upcoming tournament given player specified parameters such as current amount of GWC (from the player account), amount of funds available and the amount of time to commit.

In a number of embodiments, a player may select an option to interact with a community of players, such as an online community of players of a certain hybrid game. A player may interact with an online community through the hybrid game from one or several screens, windows and pop-ups to clearly communicate to the player a number of potential pieces of information related to the player community of players who play the particular game, or other games which might be of interest, or information related to tournaments. A player may interact with a community of players before beginning play, or during game execution to facilitate communication with other live players. A non-exhaustive list of information and interactions with a community of players would be a list of upcoming tournaments which are available to the player (possibly classed by GWC as it would relate to the amount of GWC available to a player), on-going tournament data so players could see how other players are performing, the ability to join tournaments, the ability to quit a tournament into which one is enrolled, the ability to watch an ongoing tournament as a non-participating player, a ranking of players, player avatars, accomplishments, point standings and other competitive information, the ability to send messages, invites and tournament challenges to other players in the community, the ability to request the hosting organization to arrange a custom tournament, as specified by the player, with such specifics of the tournament being (but not limited to) the GWC entry level, size in terms of the amount of players, a start time, length of the tournament, and nature of the tournament and the ability, as permitted within the system, to borrow, loan, sell or transfer GWC and other hybrid game credits to other players.

Figure 2:
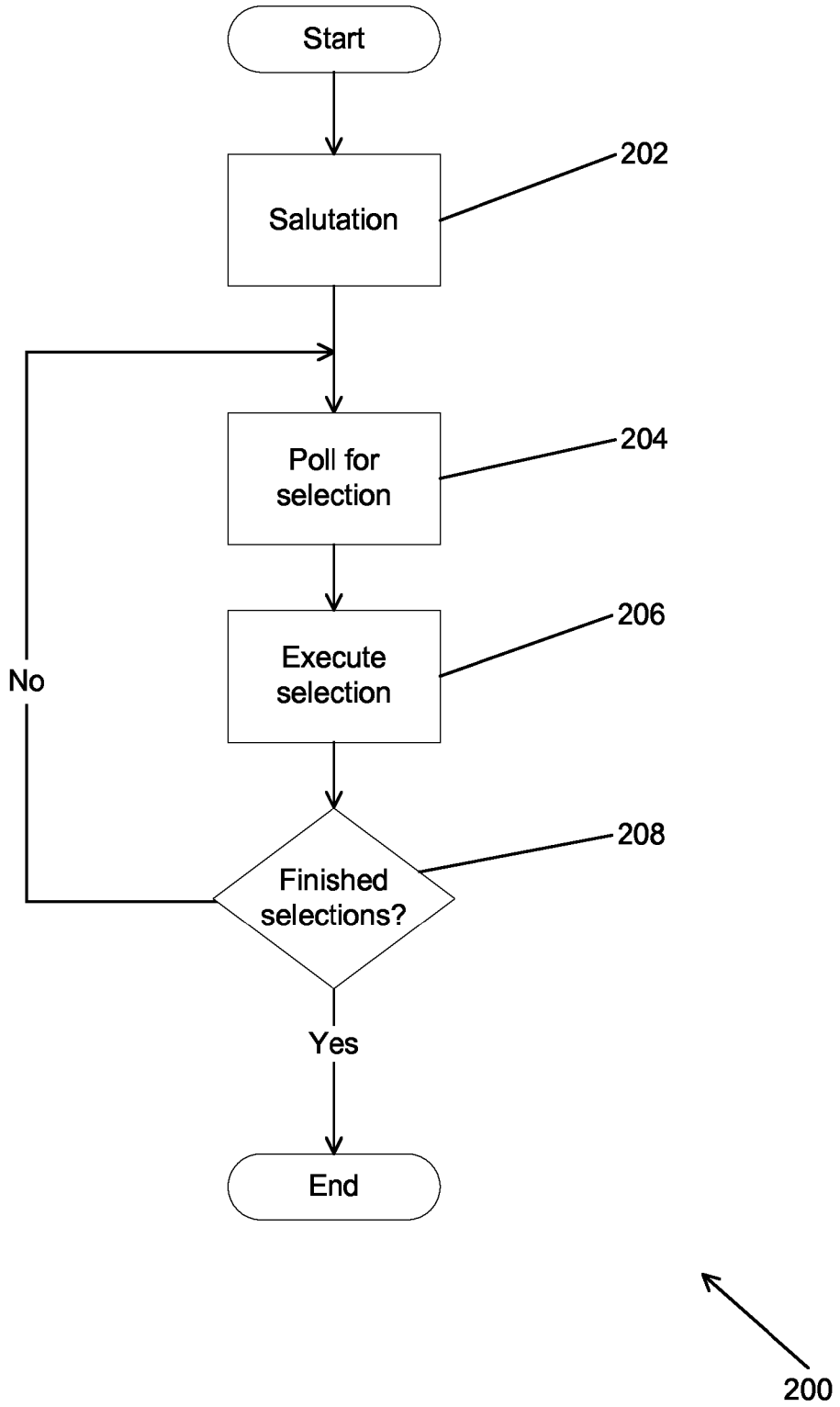
FIG. 2 illustrates a process for receiving a player selection to personalize a hybrid game in accordance with an embodiment of the invention.

A process for personalizing a hybrid game based on player selections is illustrated in FIG. 2. The process 200 includes a salutation (202) from the hybrid game. After the salutation (202), the hybrid game will poll (204) the player for a selection among different options via a user interface. After polling (204) for a player selection, the hybrid game executes (206) the selection. A decision (208) is made as to whether the player has finished with selecting options to personalize the hybrid game. If the player is not finished selecting options, the process 200 loops back to polling for player selections. If the player has finished selecting options, the process is complete.

In several embodiments, a salutation can be any kind of welcome screen that welcomes a player of the hybrid game or gives a general introduction to the hybrid game. The salutation may be selectively interwoven with game related or other types of advertising, but the intention of the salutation is to invite a player to interact with the hybrid game.

In certain embodiments, a player may interact with the hybrid game using any variety of techniques appropriate to a specific application, including utilizing a touch screen or button press. In certain embodiments, play of the hybrid game may be suspended during a session to re-invoke personalization, such as for functions related to interacting with a community of players.

Although specific options are discussed above that enable a player to personalize a hybrid game, a hybrid game can be personalized in any way as appropriate to the requirements of a specific application in accordance with embodiments of the invention. In certain embodiments, although personalization is described as being executed on a single hybrid game device, personalizable hybrid games can perform account setup, and any other options on any device, such as a personal computer, kiosk, or across different hybrid games. In numerous embodiments personalization of a hybrid game can be associated with a player account such that a player need not personalize a hybrid game again with each use of a hybrid game. In order to personalize a hybrid game, users may need information concerning the characteristics of hybrid games and the options that are available to personalize a specific hybrid game. Hybrid games including processes that display presentations and/or information that introduce players to various features of the hybrid games are discussed below.

Introducing Players to Hybrid Games

In many embodiments, a player can select an option for the hybrid game to present a game demonstration. In certain embodiments, upon selecting this option a player is taken through a short movie mode (visual and audio) showing the game in action and highlighting some of the key features of the game. One of the important functions of providing the presentation is to educate the player as to the two types of credits, RWC and GWC, to explain their interrelationship, and to confirm the player fully understands that they are gambling in the gambling game simultaneous with the operation of the entertainment game.

In various embodiments, a player may select to start a tutorial that enables a player to play the game in a controlled manner designed to teach the player how to play the hybrid game. In many embodiments, the end of a demonstration leads to an invitation to play a tutorial. A tutorial would allow a player to take a guided tour through the game, its scoring methods, use of its tools (such as but not limited to words, potions, weapons, and tanks), illustrate the interrelationship between actions in the game and gambling events, and provide additional explanations concerning tournament play.

In numerous embodiments, a player may select an option for the hybrid game to present information on odds and credit use. This information may be presented as a screen or series of screens, which display the various gambling odds in the game, and the amounts of gambling credits used and how they are correlated to actions and choices in the entertainment game. Information or disclosures as required by regulatory bodies can similarly be provided. Processes for calculating possible outcomes of hybrid game play due to modification of parameters associated with the hybrid game are discussed further below.

Odds and Credit Use

Personalizable hybrid games in many embodiments of the invention allow players to understand differing permutations of their odds and credit use when engaging in hybrid game play. In numerous embodiments, a hybrid game can include a series of screens that inform players, given their skill ranking and committed RWC, of possible outcomes if the player were to play the hybrid game, such as anticipated play time, range of potential GWC to be earned, what tournaments in process they might qualify for, and other game and game system parameters. In the event a player possesses an existing player account with the hybrid game, information related to what tournaments might be earned could be an aggregation of both their account GWC plus new GWC they may earn during the play session in question.

In many embodiments, a hybrid game may utilize a multi-variable equation or equations to calculate the odds and credit use of the hybrid game that allow a player to control the denomination and/or time scaling and other game characteristics in a hybrid game across multiple elements while solving for a particular goal. The equations used to affect this functionality can take any number of forms, including look up tables, linear equations, algebraic equations, recursive formulae, etc. In certain embodiments, goals set by a player to aspire to in play of the hybrid game, such as (but not limited to) total play time and budget (i.e. amount of money to be spent) and potential for GWC accumulation in the game, are factored into a presentation of odds and credit use. Variables that would be adjustable by the player to solve the resulting equation for the goal include (but are not limited to) the amount of RWC linked to each type of element (ranging from zero to a value, n), the desired entertainment game difficulty setting, the player's skill (which can be supplied as a function of the player's ID or volunteered by the player), the player's desire (or lack thereof) to be exposed to high value jackpots, and/or the odds profile of the gambling game(s) to be initiated through play of the hybrid game. This multi-variable equation can be represented to the player through the user interface of the hybrid game in various formats, including, but not limited to, a list of parameters with drop down lists, a list of fields where values are entered by the player, or a graphical representation of the equation using graphical dials, levers, diagrams and/or other user interface elements to affect the configuration of the equation. Some parameters are entered into the hybrid game via other mechanisms. In certain embodiments, the maximum amount of money the player wants to bet can be established by the amount of money that the player has entered into the machine via a TITO ticket or bill validator. This starting point for the amount of money to be wagered can be decreased below this amount as controlled via a user interface.

In various embodiments, for each game, the equation (s) from which odds and credit use is calculated are configured to contain independent and dependent variables. The independent variables are those that can be modified by the player, and the dependent variables are those that are calculated via an equation in the context of the independent variables' values and the goal value(s) selected by the player. The distinction between independent and dependent variables can be static (i.e. preconfigured by the hybrid) or dynamic (i.e. when the player selects a variable and alters its value, other variables are calculated in the context of the goal(s) where, as a result, these calculated variables then become "dependent").

In several embodiments, calculation of the odds and credit use of a hybrid game recalculates the dependent variable(s) of the equation (s) each time the independent variable(s) and/or goal(s) are adjusted by the player(s). A player can see the result of the calculation(s) through text and or graphical output provided by a user interface.

In certain embodiments, a hybrid game can include a car racing theme for the entertainment game. By selecting to calculate odds and credit use, a player can select from among a number of elements that may be consumed to drive wagering in the gambling game, including, but not limited to, gasoline, laps, cars passed, pit stops made, and tires replaced. The player can also establish how much RWC to commit to a gambling game for usage of each element. Furthermore, in the context of this car racing themed entertainment game of a hybrid game the player can set preferences in terms of the goal of the game play, including, but not limited to, a number of laps to race, amount of time spent on the game, and the amount of money to spend on the game.

In a number of embodiments, a change to one variable can cause alterations in others. In certain embodiments, a player can choose to initiate gambling on the basis of gas consumption where a player can choose to gamble $1 per gallon of gas consumed by his race car. In playing the hybrid game, a player may insert $20 to be used by a hybrid game (setting the amount of money available to be wagered), and also select a high risk/high reward gambling game. The personalizable hybrid game, in calculating odds and credit use, will determine that this will (based on an assessment of the player's skill) provide the player with about 8 minutes of game play. If the player sees this result on the display, but would like to play longer, the player may turn a "soft dial" that is part of the hybrid game user interface to shift the 8 minutes to 16 minutes. The personalizable hybrid game can then perform a new calculation based upon a player's modification and show that the player would need to put $40 into the machine. A hybrid game can also inform the player (such as from a pop-up bubble of text in the user interface) that if he wants to only gamble $20 he can shift to a low risk/low reward gambling game of the hybrid game and play for approximately 16 minutes for the $20 currently in the machine. The player can respond by shifting the gambling game to the low risk/low reward option and accepts the settings to commence game play.

In many embodiments, a player can also set preferences for the nature of the gambling game to be initiated by actions within the entertainment game (i.e. by virtue of the elements). In certain embodiments, a player can choose between types of tradeoffs in hybrid game play such as high risk/high reward, medium risk/medium reward, and low risk/low reward for each element that they have chosen to trigger gambling games during game play.

In several embodiments, the amount of RWC contributed to the game by a player can serve as an input to equation (s) used to calculate odds and credit use, and can affect the goal(s), variables available to the player, permissible range of those variables or other aspect of the hybrid game. For example, a player contributing 10 units of RWC to a racing game implementation of the hybrid game may only have the ability to select race tracks that provide a maximum GWC win of 100 units, whereas a player contributing 100 units of RWC to the same game may have the option of selecting race tracks where maximum GWC wins of up to 10,000 GWC are possible.

Figure 3:
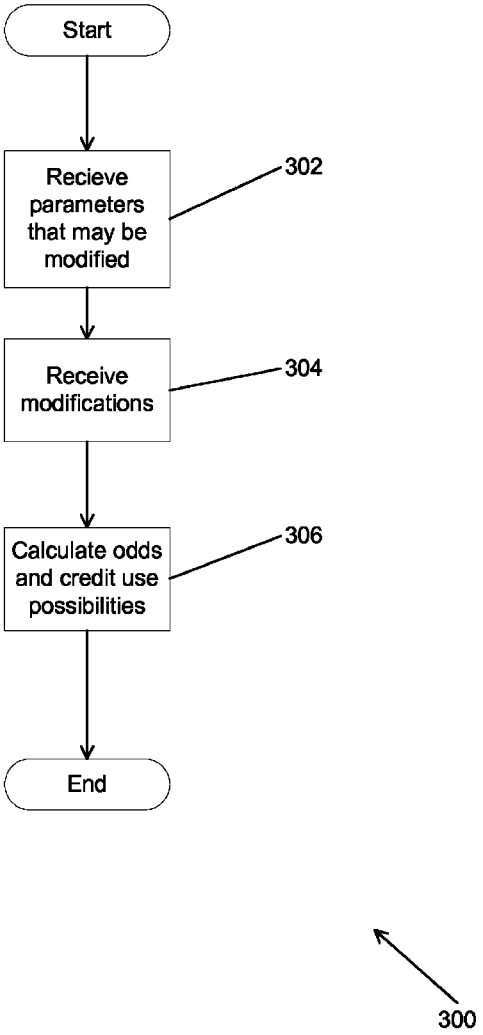
FIG. 3 illustrates a process for calculating possible outcomes of hybrid game play due to modifications of parameters in accordance with an embodiment of the invention.

A process for calculating possible outcomes of hybrid game play due to modifications to odds and/or credit options in accordance with an embodiment of the invention is illustrated in FIG. 3. The process 300 includes receiving (302) notification of the parameters that may be modified. These parameters are typically set by an entity that maintains a hybrid game, such as a casino. After receiving (302) notifications of the parameters that may be modified, modifications to the hybrid game are received (304). These modifications are typically personalized data provided by a player to a hybrid game in order to calculate odds and credit use. After receiving (304) modifications, the hybrid game can calculate (306) possible odds and credit use possibilities or other outcomes due to the modifications.

Although specific processes for calculating and using information for determining odds and credit use in a hybrid game based upon player selections are discussed above, a variety of processes for calculating and using odds and credit use may be utilized as appropriate to the requirements of a specific application in accordance with embodiments of the invention. In a variety of embodiments, the complete range of options for personalization in calculating and using odds and credit use above need not always be available to the player, and a casino can limit the player's choices to a subset of options. In the context of the above car racing game, a casino can, for example, only allow gambling games to be triggered as a function of the consumption of gas and each pit stop, with the gambling game for the former only being a low risk/low reward game and the pit stop triggered gambling game being a high risk/high reward game. Processes for storing information in a personalized player account are discussed below.

Personalization from Player Accounts

In certain embodiments, a player may set up a player account for the hybrid game. A player account can include, but is not limited to information such as (but not limited to) player personal, contact and financial information, a player's alias or handle, player avatar, preferences related to game play (such as default complexity, maximum amount of funds in a session, allowable time, etc.), preferred games, and interest in getting e-mail or other methods of contact notifications about tournaments, or advertisements.

Although specific discussions of a player account is discussed above, hybrid games can include player accounts which can store any kind of information as appropriate to the requirements of a specific application in embodiments of the invention. Processes for automatically determining a difficulty setting for an entertainment game is discussed below.

Automatically Determining Difficulty Setting for an Entertainment Game

Figure 4:
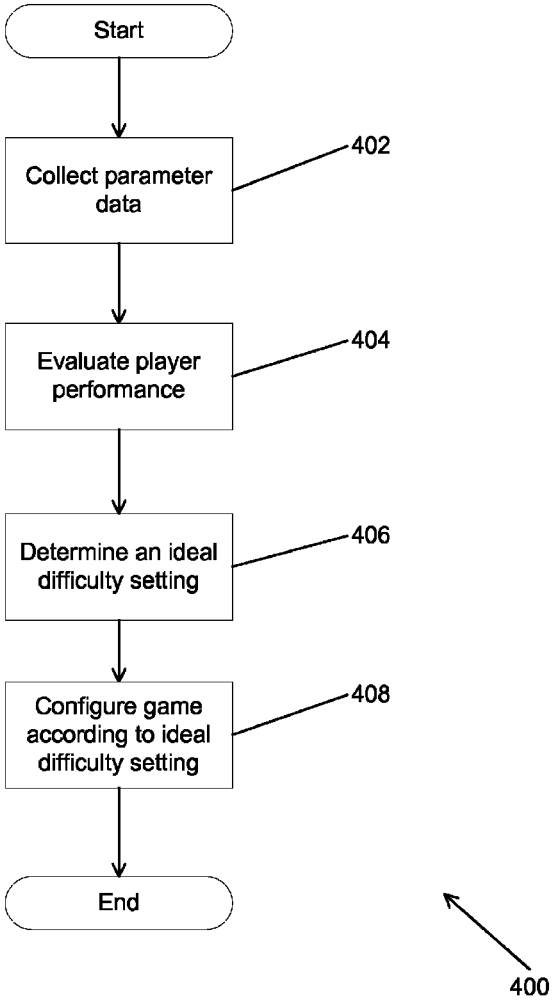
FIG. 4 illustrates a process for determining a difficulty setting for an entertainment game in accordance with an embodiment of the invention.

Personalizable hybrid games in many embodiments of the invention can be configured to offer an entertainment game set at a difficulty setting appropriate for a player's skill level. In certain embodiments, a difficulty setting of the hybrid game may be manually set, such as by a player manually entering a difficulty setting for the entertainment game. In many embodiments, a hybrid game can automatically calibrate itself to operate at an appropriate difficulty setting according to a player's skill level. A process for determining an appropriate difficulty setting of an entertainment game according to player skill level in accordance with an embodiment of the invention is illustrated in FIG. 4. The process 400 includes collecting (402) parameter data indicative of player performance at the entertainment game. Parameter data is data concerning a parameter, which is a variable of the hybrid game such as but not limited to RWC available to the gambling game, game play time, entertainment game difficulty setting, RWC accumulation rate and/or element consumption rate. Collection (402) of parameter data will be described in further detail in sections below. After collecting (402) parameter data, a player's performance is evaluated (404) for different entertainment game difficulty settings. In many embodiments, a player's performance is evaluated by ranking the player's performance across different entertainment game difficulty settings. After evaluating (404) a player's performance for different difficulty settings, an appropriate difficulty setting for the hybrid game is determined (406). In many embodiments, an appropriate difficulty setting can be determined by any variety of factors, including a maximization of the rate of GWC gain or a maximization of RWC expended. Determination (406) of an appropriate difficulty setting is discussed in sections below in further detail. After determining (406) an appropriate difficulty setting, the entertainment game of the hybrid game can be configured (408) according to the determined appropriate difficulty setting.

Figure 5:
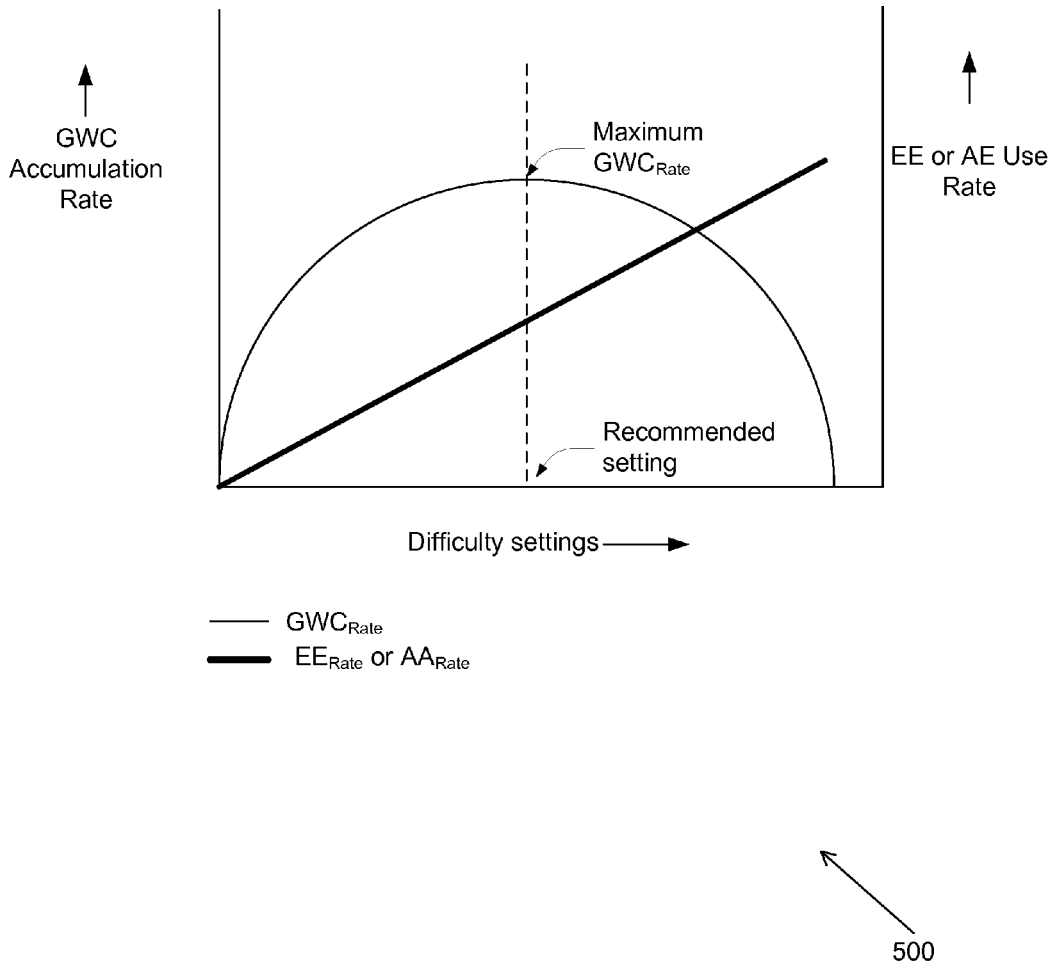
FIG. 5 illustrates a graph showing GWC accumulation rate relative to difficulty settings.

Personalizable hybrid games in accordance with many embodiments of the invention can determine an appropriate entertainment game difficulty setting for a player's skill level based upon at least one predetermined criterion, such as determining a maximum GWC accumulation rate. To illustrate this determination, a graph of parameter data is illustrated in FIG. 5. The graph 500 plots the rate of GWC accumulation against various difficulty settings of an entertainment game. In addition, the graph plots a rate of consumption of enabling elements or rate if use of action elements as the difficulty of the game increases. As one example of how such data may be utilized, an appropriate difficulty setting of an entertainment game that maximizes GWC accumulation can be determined by analyzing the curve of GWC rate versus difficulty settings for the difficulty setting at which the GWC accumulation rate is maximized, as indicated by the dashed line. Additionally, the player's rate of consumption of enabling elements and use of action elements may be determined for any of the difficulty settings, including finding the relationship between consumption of enabling elements and use of action elements at a particular GWC rate particular to an individual player. In other embodiments, alternative criteria appropriate to the requirements of a specific application can be utilized to select an appropriate difficulty level in accordance with embodiments of the invention.

Although specific examples of personalizing hybrid games based upon player skill level are discussed above, a hybrid game may be personalized based upon player skill level as appropriate to the requirements of a specific application in accordance with embodiments of the invention. Processes for collecting parameter data on player performance at specific entertainment game skill levels are discussed below.

Figure 6:
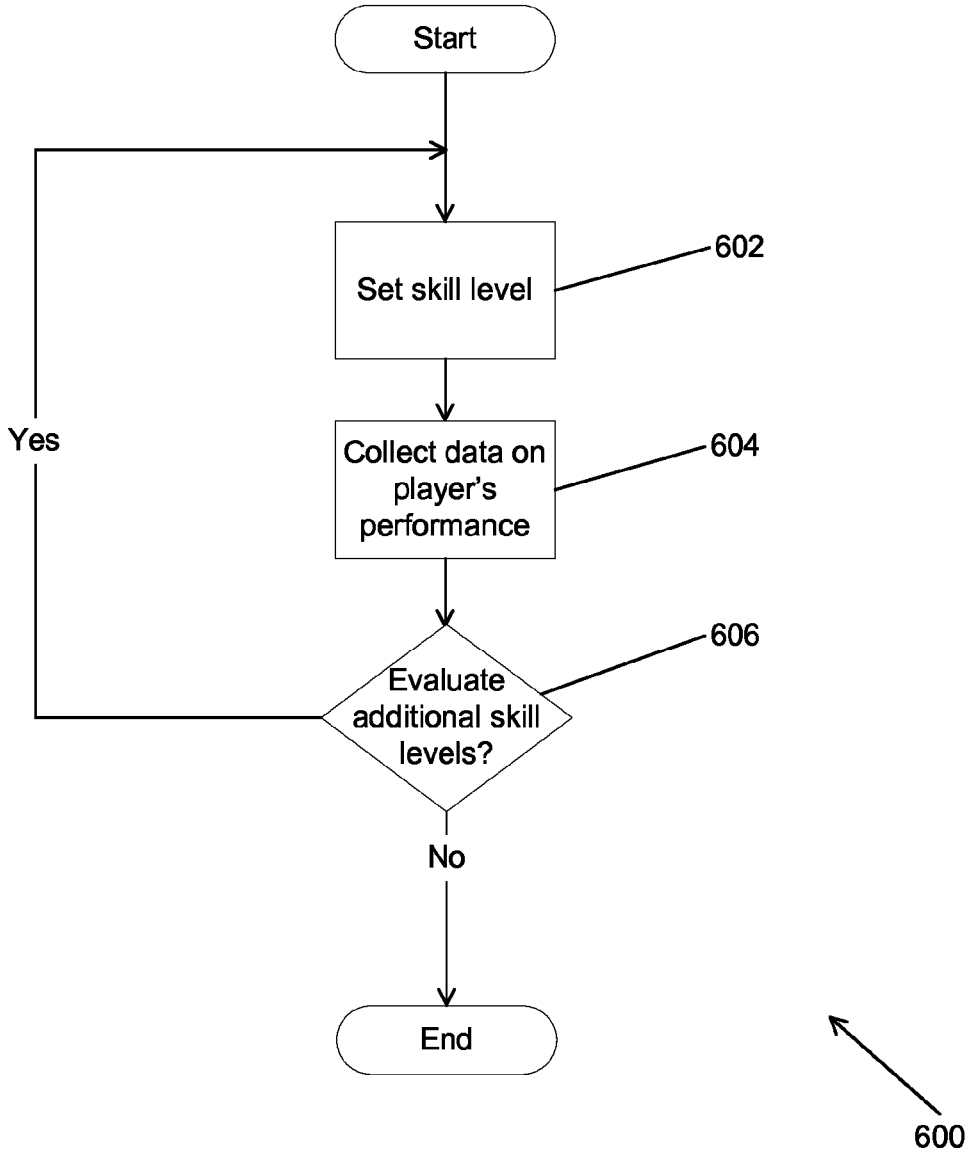
FIG. 6 illustrates a process for evaluating player performance at an entertainment game in accordance with an embodiment of the invention.

Collecting Data on Player Performance for Different Entertainment Game Difficulty Settings Personalizable hybrid games in accordance with many embodiments of the invention can collect parameter data indicative of player performance for different entertainment game difficulty settings. A process for collecting data on player performance with respect to an entertainment game in accordance with an embodiment of the invention is illustrated in FIG. 6. The process 600 includes setting (602) the entertainment game to a certain difficulty setting. After setting (602) the difficulty setting, the hybrid game collects (604) data on the player's performance at the entertainment game difficulty setting. After collecting (604) parameter data on player performance, a decision (606) is made concerning whether to evaluate player performance at additional difficulty settings is made. If an evaluation of player performance at additional difficulty settings is desired, the process loops back to setting (602) a new difficulty setting for the entertainment game. If an evaluation of a player's performance at additional difficulty settings is not desired, then the process ends. In many embodiments, the process loops through each difficulty setting that the entertainment game possesses.

In many embodiments, parameter data collected for player performance at different entertainment game difficulty settings can include any kind of parameter data relevant to determining the appropriate difficulty setting for a player's skill level. In several embodiments, a hybrid game collects parameter data on the player's performance while a player plays the entertainment game at different difficulty settings for a period of time. During that period of time, information about various parameters is collected from the player's performance at the difficulty setting. Example parameters include but are not limited to the rate at which the player accumulates GWC, the rate at which the player consumes elements, the rate at which the player is committing RWC to the game. An illustration of a collection of parameter data in a table at different difficulty settings is illustrated in FIG. 7. The parameter data collected in the table includes the GWC accumulation per unit time 704 and the element consumption per unit time 706 for each difficulty setting 702.

Referring now to FIGS. 5, 6 and 7, a process for ranking a player's ability against a difficulty level of an entertainment game of a hybrid game will now be described. The process begins by finding a maximum rate of accumulation GWC for a player while the player was playing an entertainment game of a hybrid game. It should be understood that mere inspection may be sufficient to find the maximum, such as by finding the maximum GWC rate in a table of data as shown in FIG. 7. As another exemplary process, other mathematical methods may be employed such as fitting a curve to the GWC rate versus difficulty level data and determining an inflexion in the curve, etc as shown in FIG. 5. Once a maximum is determined for the GWC rate data, then a difficulty level corresponding to the determined maximum GWC rate can be determined, indicating the ranking of the player against the difficulty levels of the entertainment game as the difficulty level at which the player accumulates GWC at the maximum rate (as indicated by the dashed line of FIG. 5). Once the difficulty rating has been established to rank the player, the difficulty rating can then be used to determine rate of enabling element or action element consumption by the player while playing the entertainment game at the determined difficulty level (again as indicated by the dashed line of FIG. 5).

TABLE 1

$$RC_{Rate} = EE_{Rate} * Ratio_{RCRate/EERate}$$

$$RC_{Total} = RC_{Rate} * T_{Total}$$

$$GWC_{Total} = GWC_{Rate} * T_{Total}$$

TABLE 1-continued $$Ratio_{GWCRate/EERate} = GWC_{Rate}/EE_{Rate}$$

$$RC_{WinRate} = f(RC_{Rate}, \text{PayTable})$$

$$EE_{IncrementRate} = RC_{WinRate} * Ratio_{EEIncrementRate/RCWinRate}$$

⋮

Table 1 is a table of exemplary simultaneous equations that may be used to define a range of outcomes for a hybrid game. As illustrated, a plurality of values can be derived for various game play parameters for a particular player and a hybrid game once the player's ability has been evaluated as described herein. The equations for deriving the values may also be used in linear programming or other mathematical processes to determine other values of interest. Such parameters include:

RCRate, a rate at which real world credits are committed to a gambling game that is part of a hybrid game;

EERate, a rate at which an enabling element or an action element is consumed by a player playing an entertainment game of a hybrid game;

RatioRCRate/EERate, a ratio of a rate of real world credits committed to a gambling game of a hybrid game to a rate of consumption of an enabling element or an action element of an entertainment game of the hybrid game;

RCTotal, a total amount of real world credit committed to a gambling game while a player is playing a hybrid game;

TTotal, a total amount of time a player plays a hybrid game;

GWCTotal, a total amount of game world credit accumulated by a player while playing a hybrid game;

GWCRate, a rate at which a player accumulated game world credit while playing a hybrid game;

RatioGWCRate/EERate, a ratio of a rate of game world credit accumulation to a rate of consumption of an enabling element or an action element of an entertainment game of a hybrid game being played by a player;

RCWinRate, a rate at which a player wins real world credits in a gambling game of a hybrid game;

PayTable, a pay table of a gambling game of a hybrid game being played by a player;

EEIncrementRate, a rate at which an enabling element or an action element is incremented as a player plays a hybrid game; and RatioEEIncrementRate/RCWinRate, a ratio of a rate of incrementing an amount of an enabling element or an action element in an entertainment game of a hybrid game to a rate of a player's winning of real world credit in a gambling game of the hybrid game.

Of course, it should be understood that many other ratios, relationships and equations may be derived from parameter data collected about a player's play of a hybrid game during an evaluation period of time.

In numerous embodiments, a player may be presented with the results of the parameter data collected during the player's play of the entertainment game and various calculated expected outcomes. For example, such a table may include rate of GWC accumulation, rate of enabling element consumption, rate of action element consumption, rate of real world credit commitment, etc. for each difficulty setting or configuration of the entertainment game. Then, the player may select for themselves a difficulty level or configuration for the entertainment game based on the player's desires. For example, the player may want to commit gambling wagers at a slower rate and would therefore want to select a lower difficulty level for the entertainment game that consumed enabling elements or used action elements at a lower rate.

Although processes for collecting parameter data indicative of player performance is discussed above, parameter data can be collected using any process as appropriate to the requirement of a specific application in accordance with embodiments of the invention. A discussion of a processing apparatus that can implement a personalizable hybrid game is discussed below.

Processing Apparatus

Figure 8:
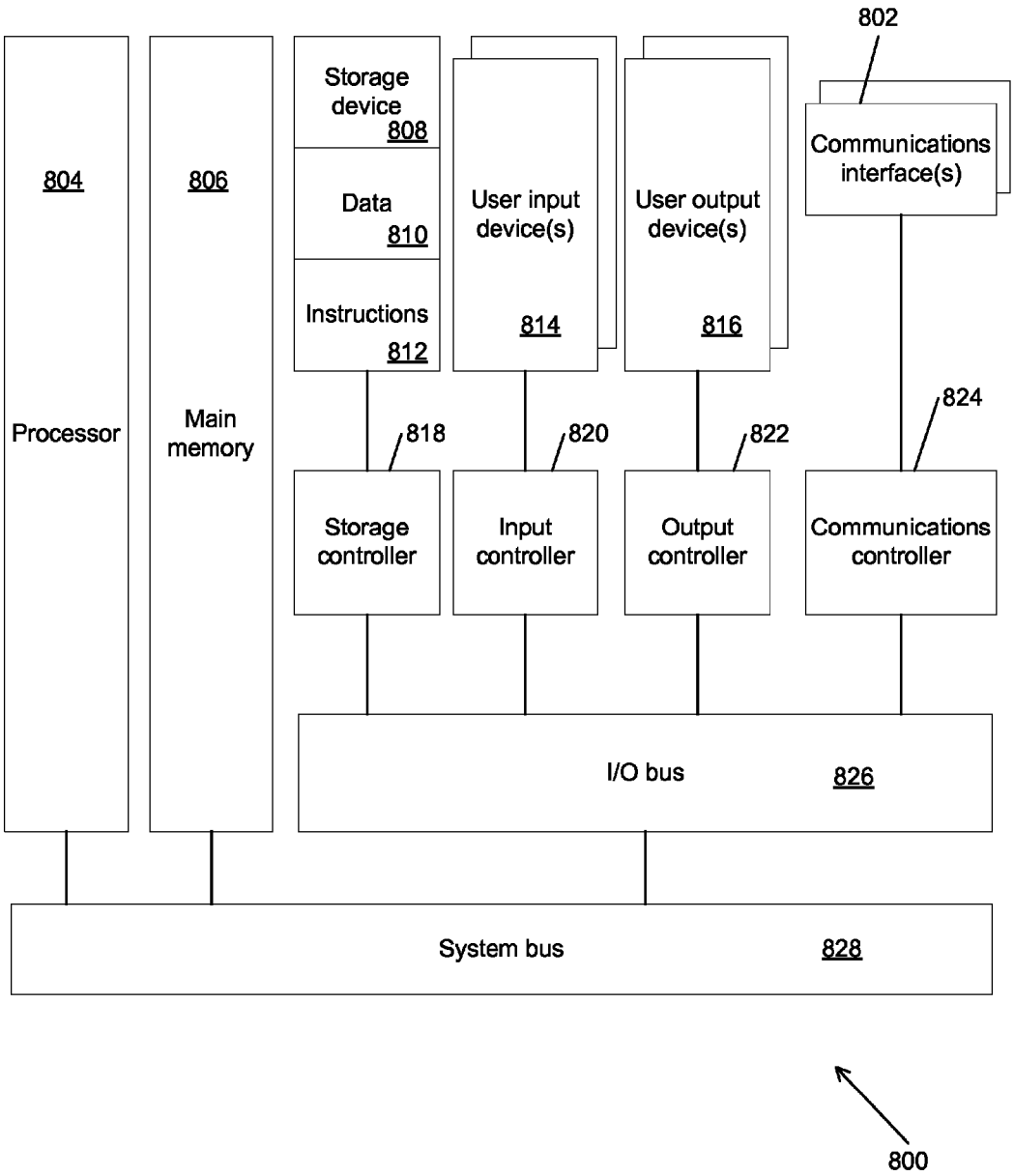
FIG. 8 illustrates a hardware architecture diagram of a processing apparatus in accordance with an embodiment of the invention.

Any of a variety of processing apparatuses can host various components of a hybrid game in accordance with embodiments of the invention. In several embodiments, these processing apparatuses can include, but are not limited to, a gaming machine, a general purpose computer, a computing device and/or a controller. A processing apparatus that is configured to implement a personalizable hybrid game in accordance with various exemplary embodiments of the invention is illustrated in FIG. 8. In the processing apparatus 800, a processor 804 is coupled to a memory 806 by a bus 828. The processor 804 is also coupled to non-transitory processor-readable storage media, such as a storage device 808 that stores processor-executable instructions 812 and data 810 through the system bus 828 to an I/O bus 826 through a storage controller 818. The processor 804 is also coupled to one or more interfaces that may be used to connect the processor to other processing apparatuses as well as networks as described herein. The processor 804 is also coupled via the bus to user input devices 814, such as tactile devices including (but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 804 is connected to these user input devices 814 through the system bus 828, to the I/O bus 826 and through the input controller 820. The processor 804 is also coupled via the bus to user output devices 816 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 828 to the I/O bus 826 and through the output controller 822. The processor 804 can also be connected to a communications interface 802 from the system bus 828 to the I/O bus 826 through a communications controller 824.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as (but not limited to) a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, a GWE and an ESE as described herein can be implemented on multiple processing apparatuses, whether dedicated, shared or distributed in any combination thereof, or may be implemented on a single processing apparatus. In addition, while certain aspects and features of a personalizable hybrid game described herein have been attributed to an RWE, a GWE or an ESE, these aspects and features may be implemented in a hybrid form where any of the features or aspects may be performed by any of a RWE, GWE or ESE within a personalizable hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A method of operating a gaming system, comprising:

providing by the gaming system a real world engine configured to provide a randomly generated payout for a gambling game;

providing by the gaming system a game world engine configured to manage an entertainment software engine to provide outcomes based upon a player's skillful execution of an entertainment game;

collecting parameter data by the gaming system indicative of player performance during the player's skillful execution of the entertainment game at each of a plurality of difficulty settings, the parameter data indicative of wagering in the gambling game as triggered by the player's actions during the player's skillful execution of the entertainment game and indicative of a rate of accumulation of game world credit during the player's skillful execution of the entertainment game;

selecting by the gaming system a difficulty setting from the plurality of difficulty settings for the entertainment game based upon the collected parameter data; and determining by the gaming system a wager of an amount of real world credit wagered in the gambling game based on the difficulty setting selected from the plurality of difficulty settings for the entertainment game, the wager triggered by actions taken by the player during the player's skillful execution of the entertainment game at the difficulty setting level, where the real world credit is credit used in the gambling game.

2. The method of claim 1, further comprising:

determining by the gaming system a rate of consumption of an element of the entertainment game based on the difficulty setting for the entertainment game, where the element is a limited resource utilized within the entertainment game to advance gameplay in the entertainment game and trigger a wager in the gambling game; and determining by the gaming system an amount of real world credit to be wagered based on the determined rate of consumption of the element.

3. The method of claim 1, further comprising:

receiving by the gaming system a modification of a parameter indicative of player performance at the entertainment game; and determining by the gaming system the amount of real world credit to be wagered based on the modification of the parameter.

4. The method of claim 3, wherein the modification of the parameter is a modification of the length of time that the player is playing the entertainment game.

5. The method of claim 3, wherein the modification of the parameter is a modification of an amount of real world credit that can be wagered.

6. A gaming system, comprising:

a real world engine constructed to provide a randomly generated payout of real world credit from a wager of real world credit in a gambling game;

an entertainment software engine constructed to provide outcomes based upon a player's skillful execution of an entertainment game; and a game world engine constructed to:

collect parameter data indicative of player performance during the player's skillful execution of the entertainment game at each of a plurality of difficulty settings, the parameter data indicative of wagering in the gambling game as triggered by the player's actions during the player's skillful execution of the entertainment game and indicative of a rate of accumulation of game world credit during the player's skillful execution of the entertainment game;

select a difficulty setting from the plurality of difficulty settings for the skill based entertainment game based upon the collected parameter data; and determine a wager of an amount of real world credit wagered in the gambling game based on the difficulty setting selected from the plurality of difficulty settings for the entertainment game, the wager triggered by actions taken by the player during the player's skillful execution of the entertainment game at the difficulty setting, where the real world credit is credit used in the gambling game.

7. The gaming system of claim 6, wherein the game world engine is further constructed to:

determine a rate of consumption of an element of the entertainment game based on the difficulty setting for the entertainment game, where the element is a limited resource utilized within the entertainment game to advance gameplay in the entertainment game and trigger a wager in the gambling game; and determine an amount of real world credit wagered based on the determined rate of consumption of the element.

8. The gaming system of claim 6, wherein the game world engine is further constructed to:

receive a modification of a parameter indicative of player performance at the entertainment game; and determine the amount of real world credit to be wagered based on the modification of a parameter.

9. The gaming system of claim 8, wherein the modification of a parameter is a modification of a length of time that the player is playing the entertainment game.

10. A non-transitory processor-readable storage medium storing processor-executable instructions for a method of operating a gaming system, the instructions comprising:

providing by the gaming system a real world engine configured to provide a randomly generated payout for a gambling game;

providing by the gaming system a game world engine configured to manage an entertainment software engine to provide outcomes based upon a player's skillful execution of an entertainment game;

collecting parameter data by the gaming system indicative of player performance during the player's skillful execution of the entertainment game at each of a plurality of difficulty settings, the parameter data indicative of wagering in the gambling game as triggered by the player's actions during the player's skillful execution of the entertainment game and indicative of a rate of accumulation of game world credit during the player's skillful execution of the entertainment game;

selecting by the gaming system a difficulty setting from the plurality of difficulty settings for the entertainment game based upon the collected parameter data; and determining by the gaming system a wager of an amount of real world credit wagered in the gambling game based on the difficulty setting selected from the plurality of difficulty settings for the entertainment game, the wager triggered by actions taken by the player during the player's skillful execution of the entertainment game at the difficulty setting, where the real world credit is credit used in the gambling game.

11. The non-transitory processor-readable storage medium of claim 10, the instructions further comprising:

determining a rate of consumption of an element of the entertainment game based on the selected difficulty setting for the entertainment game, where an element is a limited resource utilized within the entertainment game to advance gameplay; and determining the amount of real world credit wagered based on the determined rate of consumption of the element.

12. The non-transitory processor-readable storage medium of claim 10, the instructions further comprising:

receiving a modification of a parameter indicative of player performance at the entertainment game; and determining the amount of real world credit wagered based on the modification of the parameter.

13. The non-transitory processor-readable storage medium of claim 12, wherein the modification of the parameter is a modification of the length of time that a player is playing the entertainment game.

14. The non-transitory processor-readable storage medium of claim 12, wherein the modification of the parameter is a modification of an amount of real world credit that can be wagered.

* * * * *